US011823618B2

(12) United States Patent
Liu et al.

(10) Patent No.: US 11,823,618 B2
(45) Date of Patent: Nov. 21, 2023

(54) DISPLAYING DEVICE AND CONTROLLING METHOD THEREOF

(71) Applicants: BOE Intelligent IoT Technology Co., LTD., Beijing (CN); BOE Technology Group Co., Ltd., Beijing (CN)

(72) Inventors: Xingchen Liu, Beijing (CN); Jinghua Yang, Beijing (CN); Wei Lin, Beijing (CN); Yushun Jie, Beijing (CN); Yao Zhang, Beijing (CN); Guoshuai Zhu, Beijing (CN)

(73) Assignees: BOE Intelligent IoT Technology Co., LTD., Beijing (CN); BOE Technology Group Co., Ltd., Beijing (CN)

( * ) Notice: Subject to any disclaimer, the term of this patent is extended or adjusted under 35 U.S.C. 154(b) by 138 days.

(21) Appl. No.: 17/635,020

(22) PCT Filed: Apr. 25, 2021

(86) PCT No.: PCT/CN2021/089582
§ 371 (c)(1),
(2) Date: Feb. 14, 2022

(87) PCT Pub. No.: WO2022/226681
PCT Pub. Date: Nov. 3, 2022

(65) Prior Publication Data
US 2023/0343281 A1 Oct. 26, 2023

(51) Int. Cl.
*G09G 3/3208* (2016.01)

(52) U.S. Cl.
CPC ..... *G09G 3/3208* (2013.01); *G09G 2310/08* (2013.01); *G09G 2320/0257* (2013.01);
(Continued)

(58) Field of Classification Search
CPC ..... G09G 3/3208; G09G 2310/08; G09G 2320/0257; G09G 2320/046; G09G 2330/021; G09G 2330/027
See application file for complete search history.

(56) References Cited

U.S. PATENT DOCUMENTS

2010/0026673 A1* 2/2010 Cheng ..... G09G 3/3648 345/211
2017/0337879 A1* 11/2017 Oishi ..... G02F 1/1368
(Continued)

*Primary Examiner* — Premal R Patel
(74) *Attorney, Agent, or Firm* — IPro, PLLC

(57) ABSTRACT

The present application provides a displaying device and a controlling method thereof, which relates to the technical field of displaying. The displaying device can solve the problem of residual images generated in power-off and greatly improve the product quality and the user experience. The displaying device includes: a time-sequence controlling circuit, a power-supply circuit, a system controlling circuit and a display panel; the power-supply circuit is electrically connected to the time-sequence controlling circuit and the system controlling circuit, and is configured for: providing a first power-supply voltage and a second power-supply voltage to the time-sequence controlling circuit, wherein a magnitude of the first power-supply voltage and that of the second power-supply voltage are different; in a normal shutdown mode, under control of the system controlling circuit, firstly shutting down an output of the first power-supply voltage, after a first time period, shutting down an output of the second power-supply voltage.

20 Claims, 4 Drawing Sheets

(52) U.S. Cl.
CPC . *G09G 2320/046* (2013.01); *G09G 2330/021* (2013.01); *G09G 2330/027* (2013.01)

(56) References Cited

U.S. PATENT DOCUMENTS

| | | | | |
|---|---|---|---|---|
| 2019/0228694 | A1* | 7/2019 | Lee | G09G 3/20 |
| 2020/0143744 | A1* | 5/2020 | Kim | G09G 3/3233 |
| 2021/0272493 | A1* | 9/2021 | Nam | G09G 3/20 |

* cited by examiner

DISPLAYING DEVICE AND CONTROLLING METHOD THEREOF

TECHNICAL FIELD

The present application relates to the technical field of displaying, and particularly relates to a displaying device and a controlling method thereof.

BACKGROUND

Organic Light Emitting Diode (OLED) display screens have the characteristics of spontaneous light, a high contrast, a low thickness, a wide angle of view, a fast reaction speed, usage in flexible panels, a wide usage temperature range, easy manufacture and so on.

After an OLED display screen works at a high brightness for a long time, if the power supply is suddenly cut off, residual images may appear on the screen. If the residual images remain for a long time, it is easy to cause permanent burn-in, which reduces the product quality and affects the user experience.

SUMMARY

The embodiments of the present application provide a displaying device and a controlling method thereof. The displaying device can solve the problem of residual images generated in power-off and greatly improve the product quality and the user experience.

In order to achieve the above purposes, the embodiment of the present application uses technical schemes as follows:

In an aspect, a displaying device is provided, comprising: a time-sequence controlling circuit, a power-supply circuit, a system controlling circuit and a display panel;

the power-supply circuit is electrically connected to the time-sequence controlling circuit and the system controlling circuit, and is configured for: providing a first power-supply voltage and a second power-supply voltage to the time-sequence controlling circuit, wherein a magnitude of the first power-supply voltage and a magnitude of the second power-supply voltage are different; and in a normal shutdown mode, and under control of the system controlling circuit, firstly shutting down an output of the first power-supply voltage, and after a first time period, shutting down an output of the second power-supply voltage;

the time-sequence controlling circuit is electrically connected to the display panel, and is configured for: in the normal shutdown mode, and before the power-supply circuit performs time-shared shutting-down to the output of the first power-supply voltage and the output of the second power-supply voltage, performing a shutting-down compensating operation, to make the display panel display a black frame; and after the power-supply circuit shuts down the output of the first power-supply voltage, and before the power-supply circuit shuts down the output of the second power-supply voltage, stopping outputting a panel power-supply voltage to the display panel; and the system controlling circuit is electrically connected to the time-sequence controlling circuit, and is configured for: determining whether the displaying device is in the normal shutdown mode; if yes, controlling the time-sequence controlling circuit to perform a shutting-down compensation; and after the shutting-down compensation is completed, controlling the power-supply circuit to perform time-shared shutting-down to the output of the first power-supply voltage and the output of the second power-supply voltage.

Optionally, the displaying device further comprises a controlling signal line, and the controlling signal line is electrically connected to the system controlling circuit and the power-supply circuit; and the power-supply circuit is further configured for: in the normal shutdown mode, and under the control of the system controlling circuit by using a controlling signal transmitted via the controlling signal line, firstly shutting down the output of the first power-supply voltage, and after the first time period, shutting down the output of the second power-supply voltage.

Optionally, the time-sequence controlling circuit is further configured for: in the normal shutdown mode, and before the power-supply circuit performs time-shared shutting-down to the output of the first power-supply voltage and the output of the second power-supply voltage, outputting a black-frame image-data signal to the display panel, to make the display panel display the black frame.

Optionally, the time-sequence controlling circuit is further configured for: after performing the shutting-down compensating operation, determining whether the shutting-down compensation is completed; and if yes, performing feedback of a shutting-down-compensation-completion signal to the system controlling circuit; and the system controlling circuit is further configured for: acquiring the shutting-down-compensation-completion signal, and according to the shutting-down-compensation-completion signal, after the shutting-down compensation is completed, controlling the power-supply circuit to perform time-shared shutting-down to the output of the first power-supply voltage and the output of the second power-supply voltage.

Optionally, the displaying device further comprises: a shutting-down-compensation line; and the time-sequence controlling circuit is further configured for: performing feedback of the shutting-down-compensation-completion signal to the system controlling circuit through the shutting-down-compensation line.

Optionally, the system controlling circuit is further configured for: determining whether a shutting-down instruction is received; and if yes, determining that the displaying device is in the normal shutdown mode.

Optionally, the displaying device further comprises: a shutting-down-compensation line; and the system controlling circuit is further configured for: through the shutting-down-compensation line, transmitting a shutting-down-compensation signal to the time-sequence controlling circuit, and controlling the time-sequence controlling circuit to perform the shutting-down compensation.

Optionally, the displaying device further comprises a controlling signal line, and the controlling signal line is electrically connected to the system controlling circuit and the power-supply circuit; and the system controlling circuit is further configured for: after the shutting-down compensation is completed, transmitting a controlling signal to the power-supply circuit through the controlling signal line, and controlling the power-supply circuit to perform time-shared shutting-down to the output of the first power-supply voltage and the output of the second power-supply voltage.

Optionally, the time-sequence controlling circuit is further configured for: determining whether the displaying device is in an abnormal shutdown mode; and if yes, stopping outputting the panel power-supply voltage to the display panel; and the power-supply circuit is further configured for: determining whether the displaying device is in the abnormal shutdown mode; and if yes, according to a predetermined program, firstly shutting down the output of the first power-supply voltage, and after a second time period, shutting down the output of the second power-supply voltage.

Optionally, the displaying device further comprises an abnormal-power-off line and a controlling signal line, the abnormal-power-off line is electrically connected to the system controlling circuit and the time-sequence controlling circuit, and the controlling signal line is electrically connected to the system controlling circuit and the power-supply circuit;

the time-sequence controlling circuit is further configured for: according to an abnormal-power-off signal transmitted via the abnormal-power-off line, determining whether the displaying device is in the abnormal shutdown mode;

the power-supply circuit is further configured for: according to a controlling signal transmitted via the controlling signal line, determining whether the displaying device is in the abnormal shutdown mode; and the system controlling circuit is further configured for: in the abnormal shutdown mode, stopping transmitting signals to the abnormal-power-off line and the controlling signal line.

Optionally, the time-sequence controlling circuit comprises a time-sequence controlling board, the power-supply circuit comprises a power-supply board and the system controlling circuit comprises a main board.

Optionally, the system controlling circuit is further configured for: determining whether a starting-up instruction is received; and if yes, controlling the power-supply circuit to start up the output of the first power-supply voltage and the output of the second power-supply voltage; and the power-supply circuit is further configured for: under the control of the system controlling circuit, starting up the output of the first power-supply voltage and the output of the second power-supply voltage.

Optionally, the displaying device further comprises a controlling signal line, and the controlling signal line is electrically connected to the system controlling circuit and the power-supply circuit;

the system controlling circuit is further configured for: transmitting a controlling signal to the power-supply circuit through the controlling signal line, and controlling the power-supply circuit to start up the output of the first power-supply voltage and the output of the second power-supply voltage; and the power-supply circuit is further configured for: under the control of the controlling signal outputted by the system controlling circuit, starting up the output of the first power-supply voltage and the output of the second power-supply voltage.

Optionally, the displaying device further comprises: a first power-supply line and a second power-supply line, the first power-supply line is electrically connected to the power-supply circuit and the time-sequence controlling circuit, and the second power-supply line is electrically connected to the power-supply circuit and the time-sequence controlling circuit; and the power-supply circuit is further configured for: providing the first power-supply voltage to the time-sequence controlling circuit through the first power-supply line; and providing the second power-supply voltage to the time-sequence controlling circuit through the second power-supply line.

Optionally, the first power-supply voltage is greater than the second power-supply voltage.

In another aspect, a controlling method of the displaying device sated above is provided. The displaying device comprises: a time-sequence controlling circuit, a power-supply circuit, a system controlling circuit and a display panel, and the controlling method comprises:

by the system controlling circuit, determining whether the displaying device is in a normal shutdown mode, and if yes, controlling the time-sequence controlling circuit to perform a shutting-down compensation;

by the time-sequence controlling circuit, in the normal shutdown mode, performing a shutting-down compensating operation, to make the display panel display a black frame;

by the system controlling circuit, after the shutting-down compensation is completed, controlling the power-supply circuit to perform time-shared shutting-down to the output of the first power-supply voltage and the output of the second power-supply voltage;

by the power-supply circuit, in the normal shutdown mode, and under control of the system controlling circuit, firstly shutting down an output of the first power-supply voltage, and after a first time period, shutting down an output of the second power-supply voltage; and by the time-sequence controlling circuit, after the power-supply circuit shuts down the output of the first power-supply voltage, and before the power-supply circuit shuts down the output of the second power-supply voltage, stopping outputting a panel power-supply voltage to the display panel.

Optionally, the step of, by the system controlling circuit, determining whether the displaying device is in the normal shutdown mode comprises:

by the system controlling circuit, determining whether a shutting-down instruction is received; and if yes, determining that the displaying device is in the normal shutdown mode.

Optionally, the step of, by the time-sequence controlling circuit, in the normal shutdown mode, performing the shutting-down compensating operation, to make the display panel display the black frame comprises:

by the time-sequence controlling circuit, in the normal shutdown mode, outputting a black-frame image-data signal to the display panel, to make the display panel display the black frame.

Optionally, after the step of, by the time-sequence controlling circuit, in the normal shutdown mode, performing the shutting-down compensating operation, to make the display panel display the black frame, and before the step of, by the system controlling circuit, after the shutting-down compensation is completed, controlling the power-supply circuit to perform time-shared shutting-down to the output of the first power-supply voltage and the output of the second power-supply voltage, the method further comprises:

by the time-sequence controlling circuit, determining whether the shutting-down compensation is completed;

if yes, performing feedback of a shutting-down-compensation-completion signal to the system controlling circuit; and the step of, by the system controlling circuit, after the shutting-down compensation is completed, controlling the power-supply circuit to perform time-shared shutting-down to the output of the first power-supply voltage and the output of the second power-supply voltage comprises:

by the system controlling circuit, acquiring the shutting-down-compensation-completion signal, and according to the shutting-down-compensation-completion signal, after the shutting-down compensation is completed, controlling the power-supply circuit to perform time-shared shutting-down to the output of the first power-supply voltage and the output of the second power-supply voltage.

Optionally, the method further comprises:

by the time-sequence controlling circuit, determining whether the displaying device is in an abnormal shutdown mode, and if yes, stopping outputting the panel power-supply voltage to the display panel; and by the power-supply circuit, determining whether the displaying device is in the abnormal shutdown mode, and if yes, according to a predetermined program, firstly shutting down the output of the first power-supply voltage, and after a second time period, shutting down the output of the second power-supply voltage.

The above description is merely a summary of the technical solutions of the present application. In order to more clearly know the elements of the present application to enable the implementation according to the contents of the description, and in order to make the above and other purposes, features and advantages of the present application more apparent and understandable, the particular embodiments of the present application are provided below.

BRIEF DESCRIPTION OF THE DRAWINGS

In order to more clearly illustrate the technical solutions of the embodiments of the present application or the prior art, the figures that are required to describe the embodiments or the prior art will be briefly introduced below. Apparently, the figures that are described below are embodiments of the present application, and a person skilled in the art can obtain other figures according to these figures without paying creative work.

DETAILED DESCRIPTION OF THE EMBODIMENTS

In order to make the objects, the technical solutions and the advantages of the embodiments of the present application clearer, the technical solutions of the embodiments of the present application will be clearly and completely described below with reference to the drawings of the embodiments of the present application. Apparently, the described embodiments are merely certain embodiments of the present application, rather than all of the embodiments. All of the other embodiments that a person skilled in the art obtains on the basis of the embodiments of the present application without paying creative work fall within the protection scope of the present application.

In the embodiments of the present application, terms such as "first" and "second" are used to distinguish identical items or similar items that have substantially the same functions and effects, merely in order to clearly describe the technical solutions of the embodiments of the present application, and should not be construed as indicating or implying the degrees of importance or implicitly indicating the quantity of the specified technical features.

Figure 1:
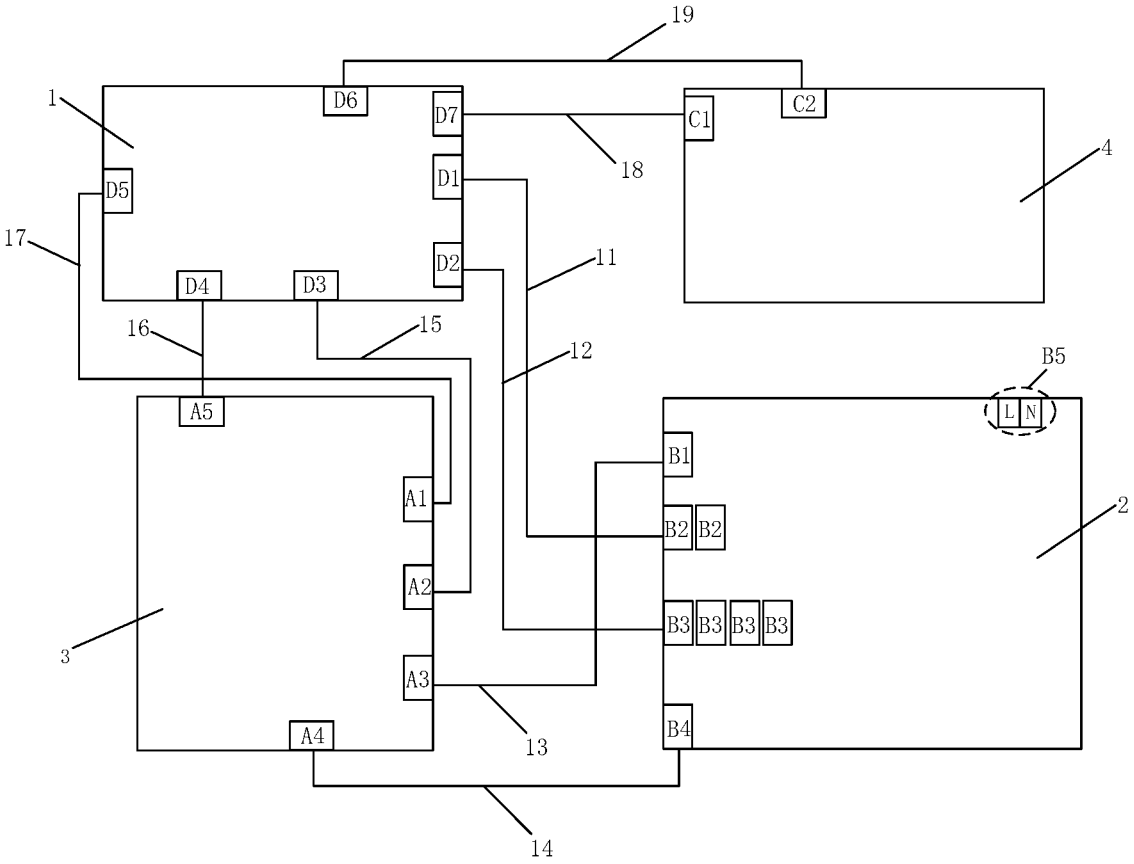
FIG. 1 schematically illustrates a structure of a displaying device.

An embodiment of the present application provides a displaying device. Referring to FIG. 1, the displaying device comprises: a time-sequence controlling circuit 1, a power-supply circuit 2, a system controlling circuit 3 and a display panel 4.

Referring to FIG. 1, the power-supply circuit 2 is electrically connected to the time-sequence controlling circuit 1 and the system controlling circuit 3, and is configured for: providing a first power-supply voltage and a second power-supply voltage to the time-sequence controlling circuit, wherein a magnitude of the first power-supply voltage and a magnitude of the second power-supply voltage are different; and in a normal shutdown mode, and under control of the system controlling circuit, firstly shutting down an output of the first power-supply voltage, and after a first time period, shutting down an output of the second power-supply voltage.

The particular structure of the power-supply circuit described above is not limited. In order to provide a plurality of power-supply voltages to the time-sequence controlling circuit, referring to FIG. 1, the power-supply circuit 2 may comprise a first power supplying terminal B2 and a second power supplying terminal B3. The time-sequence controlling circuit 1 may comprise a first power-supply inputting interface D1 and a second power-supply inputting interface D2. The first power supplying terminal B2 is electrically connected to the first power-supply inputting interface D1, and the second power supplying terminal B3 is electrically connected to the second power-supply inputting interface D2. The above displaying device may further comprise a first power-supply line 11 and a second power-supply line 12. The two ends of the first power-supply line 11 are electrically connected to the first power supplying terminal B2 and the first power-supply inputting interface D1. The two ends of the second power-supply line 12 are electrically connected to the second power supplying terminal B3 and the second power-supply inputting interface D2. The above first power-supply voltage may be greater than the second power-supply voltage, or the first power-supply voltage may be less than the second power-supply voltage, which is not limited herein. In order to facilitate design and control, the first power-supply voltage may be selected to be greater than the second power-supply voltage. For example, the first power-supply voltage is 24 v, and the second power-supply voltage is 12 v. It should be noted that the quantities of the first power supplying terminals and the second power supplying terminals comprised in the power-supply circuit are not limited. In order to improve the flexibility of applications, the power-supply circuit may comprise a plurality of first power supplying terminals and a plurality of second power supplying terminals. FIG. 1 illustrates with the power-supply circuit 2 comprising two first power supplying terminals B2 and four second power supplying terminals B3 as an example.

The way of the power-supply circuit described above of implementing shutting down the output of the second power-supply voltage after the first time period is not limited. For example, in the power-supply circuit, capacitors and other storage units may be provided in the circuit that generates the second power-supply voltage. After a controlling signal of the system controlling circuit is obtained, firstly the output of the first power-supply voltage is shut down. Due to the discharge effect of the capacitors and other storage units, the output of the second power-supply voltage can be maintained for a period of time, till the discharge of the capacitors and other storage units complete, so as to implement the delayed shutting-down of the second power-supply voltage. The particular duration of the first time period described above is not limited, and it may be determined according to actual requirements; for example, the first time period may be 50 ms.

Certainly, the power-supply circuit described above may also be configured to supply a system power-supply voltage to the system controlling circuit. The quantity and magnitude of the system power-supply voltage provided by the power-supply circuit to the system controlling circuit is not limited herein. For example, the system power-supply voltage may be 5 v, 24 v, etc. The power-supply circuit may provide 5 v and 24 v voltages to the system controlling circuit simultaneously. Referring to FIG. 1, the power-supply circuit 2 may further comprise a main-board power supplying terminal B1, the system controlling circuit 3 may further comprise a power-supply inputting interface A3, and the displaying device may further comprise a main-board power-supply line 13. The two ends of the main-board power-supply line 13 are electrically connected to the main-board power supplying terminal B1 and the power-supply inputting interface A3. The power-supply circuit 2 provides the system power-supply voltage to the system controlling circuit 3 through the main-board power-supply line 13.

The normal shutdown mode comprises that the user normally shuts down a shutting-down unit such as a shutting-down key of the displaying device to make the displaying device shut down. Certainly, the displaying device may further comprise an abnormal shutdown mode, wherein the abnormal shutdown mode comprises that non-subjective factors such as an accidental power failure make the displaying device shut down.

Referring to FIG. 1, the time-sequence controlling circuit 1 is also electrically connected to the display panel 4, and is configured for: in the normal shutdown mode, and before the power-supply circuit performs time-shared shutting-down to the output of the first power-supply voltage and the output of the second power-supply voltage, performing a shutting-down compensating operation, to make the display panel display a black frame; and after the power-supply circuit shuts down the output of the first power-supply voltage, and before the power-supply circuit shuts down the output of the second power-supply voltage, stopping outputting a panel power-supply voltage to the display panel.

There is no limitation on the particular way of the shutting-down compensating operation, as long as the display panel can display a black frame. For example, the display panel may display a black frame by inputting a black-frame image-data signal to the sub-pixels of the display panel. The black-frame image-data signal may be an image-data signal in which the gray-scale is zero. Alternatively, the sub-pixels of the display panel may be controlled to discharge, to make the display panel display a black frame. There is no limitation on the particular way of the discharge, which needs to be determined according to particular structures. Referring to FIG. 1, the time-sequence controlling circuit 1 may further comprise a data controlling terminal D6, the display panel 4 comprises a data inputting terminal C2, and the displaying device may further comprise a display-panel data controlling line 19. The two ends of the display-panel data controlling line 19 are electrically connected to the data controlling terminal D6 and the data inputting terminal C2. The time-sequence controlling circuit 1 may input the image-data signal to the display panel 4 through the display-panel data controlling line 19.

Moreover, the time-sequence controlling circuit is further configured for: providing a panel power-supply voltage to the display panel. There is no limitation of the magnitude of the panel power-supply voltage proved to the display panel herein. For example, the panel power-supply voltage may be equal to the first power-supply voltage, or the panel power-supply voltage may be equal to the second power-supply voltage, or the panel power-supply voltage may be different to the first power-supply voltage and the second power-supply voltage. If the panel power-supply voltage is not equal to the first power-supply voltage and the second power-supply voltage, in order to provide a suitable voltage to the display panel, it is necessary to dispose a voltage conversion circuit in the time-sequence controlling circuit, to convert the first power-supply voltage or the second power-supply voltage into the panel power-supply voltage. In order to minimize the change of the circuit structure and reduce the design difficulty, the panel power-supply voltage may be selected equal to the first power-supply voltage. For example, the panel power-supply voltage and the first power-supply voltage are 24 v. Referring to FIG. 1, the time-sequence controlling circuit 1 may further comprise a power-supply controlling terminal D7, the display panel 4 comprises a power-supply inputting terminal C1, and the displaying device may further comprise a display-panel power-supply controlling line 18. The two ends of the display-panel power-supply controlling line 18 are electrically connected to the power-supply controlling terminal D7 and the power-supply inputting terminal C1. The time-sequence controlling circuit 1 may output the panel power-supply voltage ELVDD to the display panel 4 through the display-panel power-supply controlling line 18.

The display panel described above may be an Organic Light Emitting Diode (OLED) display panel or a Quantum Dot Light Emitting Diodes (QLED) display panel, which is not limited herein.

Referring to FIG. 1, the system controlling circuit 3 is electrically connected to the time-sequence controlling circuit 1, and is configured for: determining whether the displaying device is in the normal shutdown mode; if yes, controlling the time-sequence controlling circuit to perform a shutting-down compensation; and after the shutting-down compensation is completed, controlling the power-supply circuit to perform time-shared shutting-down to the output of the first power-supply voltage and the output of the second power-supply voltage.

There is no limitation on the particular way of, by the system controlling circuit, determining whether the displaying device is in the normal shutdown mode herein. In order to better control the time-sequence controlling circuit, referring to FIG. 1, the system controlling circuit 1 may comprise a shutting-down-compensation controlling terminal A2, the time-sequence controlling circuit 1 may comprise a shutting-down-compensation terminal D3, the displaying device may further comprise a shutting-down-compensation line 15, and the two ends of the shutting-down-compensation line 15 are electrically connected to the shutting-down-compensation controlling terminal A2 and the shutting-down-compensation terminal D3. The system controlling circuit 3 may transmit a shutting-down-compensation signal to the time-sequence controlling circuit 1 through the shutting-down-compensation line 15, and control the time-sequence controlling circuit 1 to perform a shutting-down compensation.

In order to better control the power-supply circuit, referring to FIG. 1, the system controlling circuit 3 may comprise a controlling-signal terminal A4, the power-supply circuit 2 may comprise a control inputting terminal B4, and the displaying device may further comprise a controlling signal line 14, and the two ends of the controlling signal line 14 are electrically connected to the controlling-signal terminal A4 and the control inputting terminal B4. The system controlling circuit 3 may transmit a controlling signal to the power-supply circuit 2 via the controlling signal line 14, and control the power-supply circuit 2 to perform time-shared shutting-down to the output of the first power-supply voltage and the output of the second power-supply voltage.

Referring to FIG. 1, in order to facilitate the system controlling circuit to transmit an image-video data signal to the time-sequence controlling circuit, the displaying device may further comprise a data line 17, and the two ends of the data line 17 are electrically connected to a port A1 of the system controlling circuit 3 and a port D5 of the time-sequence controlling circuit 1. The type of the data line is not limited. For example, the data line may be a V-By-One line, and the data transmission is carried out by using a V-By-One transmission protocol. The V-By-One is a signal standard developed for high-definition digital image signal transmission, which is widely used in the field of displaying.

The displaying device according to the embodiments of the present application, in the normal shutdown mode, performs the shutting-down compensation to the display panel through the time-sequence controlling circuit, to make the display panel display a black frame before power-off. In this way, during the process of shutting-down, the frame that the user sees is a black frame, and after the black frame has been displayed, even if there is still a residual charge, the display panel still displays the black frame, so as to prevent the problem of residual images generated in power-off, and improve the user experience. Subsequently, under the control of the system controlling circuit, the power-supply circuit firstly shuts down the output of the first power-supply voltage, and after the first time period, shuts down the output of the second power-supply voltage. In this way, the time-sequence controlling circuit can obtain the second power-supply voltage to prolong the operation when the first power-supply voltage is lost. Accordingly, in case that the power supplying relies on merely the second power-supply voltage, the time-sequence controlling circuit can firstly shut down the output of the panel power-supply voltage, so as to ensure that the display panel is powered off before the time-sequence controlling circuit. In this way, the problem can be prevented that the display panel is difficult to maintain the display of the black frame and residual images appear when the time-sequence controlling circuit is powered off earlier than the display panel. That can further ensure that the displaying device eliminates the power-off residual images, and improve the product quality and the user experience.

The displaying device described above may be an OLED displaying device or a QLED displaying device, and may also be a television, a digital camera, a cell phone, a tablet or any other products or components with display functions which comprises the OLED displaying device or the QLED displaying device.

Optionally, in order to reduce the complexity of the structure, to reduce the difficulty and the cost of implementation, referring to FIG. 1, the displaying device further comprises a controlling signal line 14, and the controlling signal line 14 is electrically connected to the system controlling circuit 3 and the power-supply circuit 2.

The power-supply circuit is further configured for: in the normal shutdown mode, and under the control of the system controlling circuit by using a controlling signal transmitted via the controlling signal line, firstly shutting down the output of the first power-supply voltage, and after the first time period, shutting down the output of the second power-supply voltage.

The type and the magnitude of the controlling signal transmitted via the controlling signal line are not limited herein. For example, the controlling signal may comprise a low-level voltage signal, or the controlling signal may comprise a high-level voltage signal.

Optionally, in order to reduce the difficulty in the driving and facilitate the implementation, the time-sequence controlling circuit is further configured for: in the normal shutdown mode, and before the power-supply circuit performs time-shared shutting-down to the output of the first power-supply voltage and the output of the second power-supply voltage, outputting a black-frame image-data signal to the display panel, to make the display panel display the black frame.

The time-sequence controlling circuit outputs the black-frame image-data signal to the display panel herein. For example, the time-sequence controlling circuit may output to the display panel an image-data signal in which the gray-scale is zero. The method of the display panel displaying the black frame according to the black-frame image-data signal is not described in details herein, and the technical personnel in this field may obtain the method from relevant technologies.

Optionally, in order to reduce the driving duration, to improve the response speed of the product, the time-sequence controlling circuit is further configured for: after performing the shutting-down compensating operation, determining whether the shutting-down compensation is completed; and if yes, performing feedback of a shutting-down-compensation-completion signal to the system controlling circuit.

The method of, by the time-sequence controlling circuit, determining whether the shutting-down compensation is completed is not limited herein. For example, a shutting-down compensation time may be predetermined in advance, and the time-sequence controlling circuit may determine whether the actual compensation time reaches the predetermined shutting-down compensation time, and if yes, determine that the shutting-down compensation is completed. Certainly, it may be determined by other determining methods, which are not listed herein.

The system controlling circuit is further configured for: acquiring the shutting-down-compensation-completion signal, and according to the shutting-down-compensation-completion signal, after the shutting-down compensation is completed, controlling the power-supply circuit to perform time-shared shutting-down to the output of the first power-supply voltage and the output of the second power-supply voltage.

The system controlling circuit may, by controlling the controlling signal transmitted via the controlling signal line, control the power-supply circuit to perform time-shared shutting-down to the output of the first power-supply voltage and the output of the second power-supply voltage.

Further optionally, in order to reduce the complexity of the structure, to reduce the difficulty and the cost of implementation, referring to FIG. 1, the displaying device further comprises: a shutting-down-compensation line 15.

The time-sequence controlling circuit is further configured for: performing feedback of the shutting-down-compensation-completion signal to the system controlling circuit through the shutting-down-compensation line.

The type and the magnitude of the shutting-down-compensation-completion signal transmitted via the shutting-down-compensation line are not limited herein. For example, the shutting-down-compensation-completion signal may comprise a low-level voltage signal, or the shutting-down-compensation-completion signal may comprise a high-level voltage signal. Moreover, the shutting-down-compensation line may use an I2C protocol to transmit the shutting-down-compensation-completion signal. Certainly, it may use other protocols, which is not limited herein.

Optionally, in order to facilitate determining of whether the displaying device is in the normal shutdown mode, the system controlling circuit is further configured for: determining whether a shutting-down instruction is received; and if yes, determining that the displaying device is in the normal shutdown mode.

The particular production way of the shutting-down instruction is not limited. For example, it may be generated by pressing a physical shutting-down key by the user, or it may be generated by pressing a shutting-down key on a virtual interface by the user, or it may be generated by remote control, voice, face recognition, gesture recognition, etc.

Optionally, in order to reduce the complexity of the structure, to reduce the difficulty and the cost of implementation, referring to FIG. 1, the displaying device further comprises: a shutting-down-compensation line 15.

The system controlling circuit is further configured for: through the shutting-down-compensation line, transmitting a shutting-down-compensation signal to the time-sequence controlling circuit, and controlling the time-sequence controlling circuit to perform the shutting-down compensation.

The type and the magnitude of the shutting-down-compensation signal are not limited here. For example, the shutting-down-compensation signal may comprise a low-level voltage signal, and in this case, the shutting-down-compensation-completion signal may comprise a high-level voltage signal. Alternatively, the shutting-down-compensation signal may comprise a high-level voltage signal, and in this case, the shutting-down-compensation-completion signal may comprise a low-level voltage signal.

It should be noted that the system controlling circuit and the time-sequence controlling circuit may perform two-way communication through the shutting-down-compensation line. On one hand, the system controlling circuit may transmit the shutting-down-compensation signal to the time-sequence controlling circuit through the shutting-down-compensation line. On the other hand, the time-sequence controlling circuit may transmit the shutting-down-compensation signal to the system controlling circuit through the shutting-down-compensation line, so as to effectively improve the utilization rate and save the cost.

Optionally, in order to reduce the complexity of the structure, to reduce the difficulty and the cost of implementation, referring to FIG. 1, the displaying device further comprises a controlling signal line 14, and the controlling signal line 14 is electrically connected to the system controlling circuit 3 and the power-supply circuit 2.

The system controlling circuit is further configured for: after the shutting-down compensation is completed, transmitting a controlling signal to the power-supply circuit through the controlling signal line, and controlling the power-supply circuit to perform time-shared shutting-down to the output of the first power-supply voltage and the output of the second power-supply voltage.

The type and the magnitude of the controlling signal transmitted via the controlling signal line are not limited herein. For example, the controlling signal line may comprise a low-level voltage signal, or the controlling signal line may comprise a high-level voltage signal.

Optionally, the time-sequence controlling circuit is further configured for: determining whether the displaying device is in an abnormal shutdown mode; and if yes, stopping outputting the panel power-supply voltage to the display panel.

The power-supply circuit is further configured for: determining whether the displaying device is in the abnormal shutdown mode; and if yes, according to a predetermined program, firstly shutting down the output of the first power-supply voltage, and after a second time period, shutting down the output of the second power-supply voltage.

The durations of the second time period and the first time period described above may be equal or different, which may be determined according to practical situations. For example, the duration of the second time period may be 2000 ms, and the duration of the first time period may be 50 ms.

In this way, when the displaying device is in the abnormal shutdown mode (e.g., an unexpected power shutting-down), according to a predetermined program, the power-supply circuit firstly shuts down the output of the first power-supply voltage, and after a second time period, shuts down the output of the second power-supply voltage, so that the time-sequence controlling circuit can obtain the second power-supply voltage to prolong the operation when the first power-supply voltage is lost. Accordingly, in case that the power supplying relies on merely the second power-supply voltage, the time-sequence controlling circuit can control to shut down the output of the panel power-supply voltage, so that the display panel is powered off quickly, so as to prevent the problem of residual images due to the residual charge in the sub-pixels of the display panel caused by untimely power-off of the display panel when the time-sequence controlling circuit is powered off earlier than the display panel.

Optionally, referring to FIG. 1, the displaying device further comprises an abnormal-power-off line 16 and a controlling signal line 14, the abnormal-power-off line 16 is electrically connected to a port A5 of the system controlling circuit 3 and a port D4 of the time-sequence controlling circuit 1, and the controlling signal line 14 is electrically connected to the system controlling circuit 3 and the power-supply circuit 2.

The time-sequence controlling circuit is further configured for: according to an abnormal-power-off signal transmitted via the abnormal-power-off line, determining whether the displaying device is in the abnormal shutdown mode.

The power-supply circuit is further configured for: according to a controlling signal transmitted via the controlling signal line, determining whether the displaying device is in the abnormal shutdown mode.

The system controlling circuit is further configured for: in the abnormal shutdown mode, stopping transmitting signals to the abnormal-power-off line and the controlling signal line.

The method of, by the time-sequence controlling circuit, according to an abnormal-power-off signal transmitted via the abnormal-power-off line, determining whether the displaying device is in the abnormal shutdown mode is not limited herein. For example, in a normal working mode, the system controlling circuit transmits the high-level voltage signal to the abnormal-power-off line. In the abnormal shutdown mode, the system controlling circuit is powered off, and stops transmitting signals to the abnormal-power-off line, and then the voltage level of the abnormal-power-off signal transmitted via the abnormal-power-off line may be reversed, that is, reversing from the high-level voltage signal into the low-level voltage signal. The time-sequence controlling circuit may determine whether the displaying device is in the abnormal shutdown mode by determining whether the voltage level of the abnormal-power-off signal is reversed. Particularly, if the voltage level of the abnormal-power-off signal is reversed, then it is determined that the displaying device is in the abnormal shutdown mode, and if the voltage level of the abnormal-power-off signal is not reversed, then it is determined that the displaying device is in the non-abnormal shutdown mode.

The method of by the power-supply circuit, according to a controlling signal transmitted via the controlling signal line, determining whether the displaying device is in the abnormal shutdown mode is not limited herein. For example, in the normal working mode, the system controlling circuit may transmit a controlling signal with a high-level voltage to the controlling signal line. In the normal shutdown mode, the system controlling circuit may transmit the controlling signal with a low-level voltage to the controlling signal line. In the abnormal shutdown mode, the system controlling circuit is powered off, and stops to transmit signals to the controlling signal line, and then the controlling signal line may still output a certain level of the controlling signal in a short time, and then stops outputting signals. The power-supply circuit may determine whether the displaying device is in the abnormal shutdown mode by determining whether the controlling signals are continuously obtained. Particularly, if the power-supply circuit cannot continuously obtain the controlling signal, then it is determined that the displaying device is in the abnormal shutdown mode, and if the power-supply circuit can continuously obtain the controlling signal, then it is determined that the displaying device is in the non-abnormal shutdown mode.

Optionally, in order to facilitate the controlling, the time-sequence controlling circuit comprises a time-sequence controlling board (also known as TCON board), the power-supply circuit comprises a power-supply board, and the system controlling circuit comprises a main board.

Optionally, the system controlling circuit is further configured for: determining whether a starting-up instruction is received; and if yes, controlling the power-supply circuit to start up the output of the first power-supply voltage and the output of the second power-supply voltage.

The power-supply circuit is further configured for: under the control of the system controlling circuit, starting up the output of the first power-supply voltage and the output of the second power-supply voltage.

The particular generation mode of the starting-up instruction described above is not limited. For example, it may be generated by pressing a physical power-on key by the user, or by a remote control, or by inserting a High-Definition-Multimedia Interface (HDMI) image data cable.

The sequence for starting up the first power-supply voltage and the second power-supply voltage is not limited. For example, the first power-supply voltage and the second power-supply voltage may be started up simultaneously; or the first power-supply voltage may be started up firstly, and then the second power-supply voltage may be started up; or the second power-supply voltage may be started up firstly, and then the first power-supply voltage may be started up. For example, in order to save the time and improve the corresponding speed of power-on, the first power-supply voltage and the second power-supply voltage may be started up simultaneously.

Figure 2:
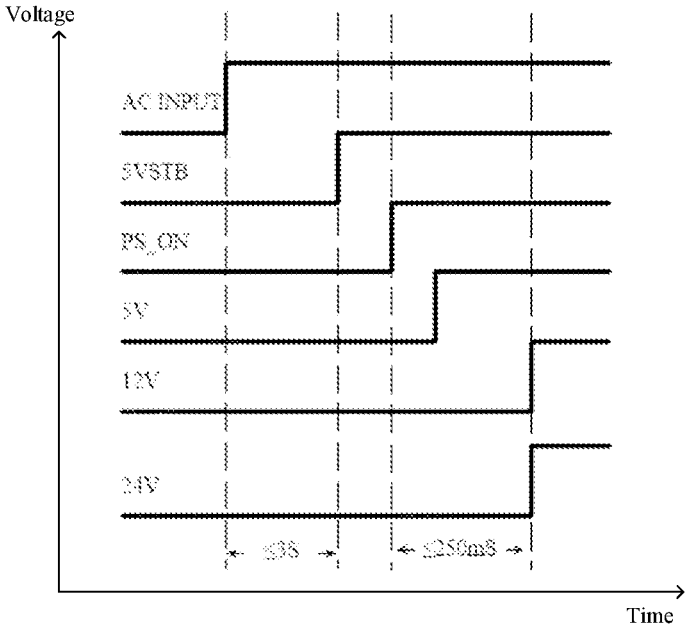
FIG. 2 schematically illustrates a diagram of a starting-up time sequence of the displaying device.

Taking the first power-supply voltage of 24 v and the second power-supply voltage of 12 v as an example, referring to the power-on time sequence diagram shown in FIG. 2, the power-on controlling method of the displaying device is explained. Referring to FIG. 2, after a socket is inserted into the displaying device, an AC INPUT signal (AC electrical signal) is started up. After less than or equal to 3 s, the standby power-supply line starts to transmit the standby power supply signal (5 vSTB signal), which makes the system controlling circuit in a standby state. Subsequently, after the system controlling circuit receives the starting-up instruction, the system controlling circuit transmits the controlling signal (PS_ON signal) to the power-supply circuit through the controlling signal line. Then, under the control of the controlling signal, the power-supply circuit first outputs a 5 v power-supply voltage, and then outputs 12 v and 24 v power-supply voltage simultaneously. Within 250 ms after the standby power signal (PS_ON signal) is started up, the power-supply voltages of 12 v and 24 v are outputted.

It should be noted that the standby power-supply line is electrically connected to the system controlling circuit and the power-supply circuit, and is configured to provide a standby power supply to the system controlling circuit. The standby power-supply line is in a state of constant power supply, and on the condition that the socket is removed or the power supply is accidentally off, the standby power-supply line stops providing power supply.

Optionally, in order to reduce the complexity of the structure, to reduce the difficulty and the cost of implementation, referring to FIG. 1, the displaying device further comprises a controlling signal line 14, and the controlling signal line 14 is electrically connected to the system controlling circuit 3 and the power-supply circuit 2.

The system controlling circuit is further configured for: transmitting a controlling signal to the power-supply circuit through the controlling signal line, and controlling the power-supply circuit to start up the output of the first power-supply voltage and the output of the second power-supply voltage.

The power-supply circuit is further configured for: under the control of the controlling signal outputted by the system controlling circuit, starting up the output of the first power-supply voltage and the output of the second power-supply voltage.

The type and the magnitude of the controlling signal transmitted via the controlling signal line are not limited herein. For example, the controlling signal may comprise a low-level voltage signal, and then, in order to facilitate distinguishing control, in the normal shutdown mode, the controlling signal transmitted via the controlling signal line may comprise a high-level voltage signal. Alternatively, the controlling signal may comprise a high-level voltage signal, and in the normal shutdown mode, the controlling signal transmitted via the controlling signal line may comprise a low-level voltage signal.

Optionally, in order to better provide different power-supply voltages to the time-sequence controlling circuit and prevent mutual interference between the different power-supply voltages, referring to FIG. 1, the displaying device further comprises: a first power-supply line 11 and a second power-supply line 12, the first power-supply line 11 is electrically connected to the power-supply circuit 2 and the time-sequence controlling circuit 1, and the second power-supply line 12 is electrically connected to the power-supply circuit 2 and the time-sequence controlling circuit 1.

The power-supply circuit is further configured for: providing the first power-supply voltage to the time-sequence controlling circuit through the first power-supply line; and providing the second power-supply voltage to the time-sequence controlling circuit through the second power-supply line.

Referring to FIG. 1, the power-supply circuit 2 described above may comprise a first power supplying terminal B2 and a second power supplying terminal B3, the time-sequence controlling circuit 1 may comprise a first power-supply inputting interface D1 and a second power-supply inputting interface D2, the two ends of the first power-supply line 11 are electrically connected to the first power supplying terminal B2 and the first power-supply inputting interface D1, and the two ends of the second power-supply line 12 are electrically connected to the second power supplying terminal B3 and the second power-supply inputting interface D2. The quantities of the first power supplying terminal and the second power supplying terminal comprised by the power-supply circuit are not limited, and in order to provide more choices and prolong the service life of the terminals, a plurality of first power supplying terminals and a plurality of second power supplying terminals may be provided. FIG. 1 illustrates the power-supply circuit comprising two first power supplying terminals B2 and four second power supplying terminals B3. Referring to FIG. 1, the power-supply circuit 2 may further comprise a socket terminal B5, which is used to electrically connect with the socket to obtain the external AC power. The socket terminal B5 may comprise a fire-line terminal (L) and a zero-line terminal (N).

It should be noted that, in order to simplify the structure, the first power-supply line and the second power-supply line described above are integrated with a ground line (GND line), and no additional ground line is provided.

The first power-supply voltage described above may be greater than the second power-supply voltage, or the first power-supply voltage may be less than the second power-supply voltage, which is not limited herein. In order to facilitate designing and controlling, optionally, the first power-supply voltage is greater than the second power-supply voltage. For example, the first power-supply voltage is 24 v and the second power-supply voltage is 12 v.

An embodiment of the present application further provides a controlling method of the displaying device described above. Referring to FIG. 1, the displaying device comprises: a time-sequence controlling circuit 1, a power-supply circuit 2, a system controlling circuit 3 and a display panel 4, and the controlling method comprises:

S01: by the system controlling circuit, determining whether the displaying device is in a normal shutdown mode, and if yes, controlling the time-sequence controlling circuit to perform a shutting-down compensation S02: by the time-sequence controlling circuit, in the normal shutdown mode, performing a shutting-down compensating operation, to make the display panel display a black frame.

S03: by the system controlling circuit, after the shutting-down compensation is completed, controlling the power-supply circuit to perform time-shared shutting-down to the output of the first power-supply voltage and the output of the second power-supply voltage.

S04: by the power-supply circuit, in the normal shutdown mode, and under control of the system controlling circuit, firstly shutting down an output of the first power-supply voltage, and after a first time period, shutting down an output of the second power-supply voltage.

S05: by the time-sequence controlling circuit, after the power-supply circuit shuts down the output of the first power-supply voltage, and before the power-supply circuit shuts down the output of the second power-supply voltage, stopping outputting a panel power-supply voltage to the display panel.

By executing S01-S05, in the normal shutdown mode, the shutting-down compensation is performed to the display panel through the time-sequence controlling circuit, to make the display panel display a black frame before power-off. In this way, during the process of shutting-down, the frame that the user sees is a black frame. After the black frame has been displayed, even if there is still a residual charge, the display panel still displays the black frame, so as to prevent the problem of residual images generated in power-off, and improve the user experience. Subsequently, under the control of the system controlling circuit, the power-supply circuit firstly shuts down the output of the first power-supply voltage, and after the first time period, shuts down the output of the second power-supply voltage. In this way, the time-sequence controlling circuit can obtain the second power-supply voltage to prolong the operation when the first power-supply voltage is lost. Accordingly, in case that the power supplying relies on merely the second power-supply voltage, the time-sequence controlling circuit can firstly shut down the output of the panel power-supply voltage, so as to ensure that the display panel is powered off before the time-sequence controlling circuit. In this way, the problem can be prevented that the display panel is difficult to maintain the display of the black frame and residual images appear when the time-sequence controlling circuit is powered off earlier than the display panel. That can further ensure that the displaying device eliminates the power-off residual images and improve the product quality and the user experience.

Optionally, in order to facilitate determining whether the displaying device is in the normal shutdown mode, in the above step S01, the step of, by the system controlling circuit, determining whether the displaying device is in the normal shutdown mode comprises:

S101: by the system controlling circuit, determining whether a shutting-down instruction is received.

The particular generation of the shutting-down instruction is not limited. For example, it may be generated by pressing a physical shutting-down key by the user, or it may be generated by pressing a key on a virtual interface by the user, or it may be generated by a remote control, voice, face recognition and gesture recognition, etc.

S102: if yes, determining that the displaying device is in the normal shutdown mode.

Optionally, in order to reduce the difficulty in the driving and facilitate the implementation, the above step S02, by the time-sequence controlling circuit, in the normal shutdown mode, performing the shutting-down compensating operation, to make the display panel display the black frame comprises:

S02', by the time-sequence controlling circuit, in the normal shutdown mode, outputting a black-frame image-data signal to the display panel, to make the display panel display the black frame.

Here, the time-sequence controlling circuit outputs the black-frame image-data signal to the display panel. For example, the time-sequence controlling circuit may output the image-data signal in which the gray-scale is zero to the display panel. Here, the method of displaying the black frame by the display panel according to the black-frame image-data signal is not described in detail, and a person skilled in the art may obtain it from relevant technologies.

Optionally, in order to reduce the driving duration, to improve the response speed of the product, after S02 of, by the time-sequence controlling circuit, in the normal shutdown mode, performing the shutting-down compensating operation, to make the display panel display the black frame, and before S03 of, by the system controlling circuit, after the shutting-down compensation is completed, controlling the power-supply circuit to perform time-shared shutting-down to the output of the first power-supply voltage and the output of the second power-supply voltage, the method described above further comprises:

S06: by the time-sequence controlling circuit, determining whether the shutting-down compensation is completed.

Here, the method of, by the time-sequence controlling circuit, determining whether the shutting-down compensation is completed is not limited. For example, the shutting-down compensation time may be set in advance. The time-sequence controlling circuit determines whether the actual compensation time reaches the predetermined shutting-down compensation time and if yes, determines that the shutting-down compensation is completed. Certainly, it may also be other determining methods, which are no longer listed herein.

S07: if yes, performing feedback of a shutting-down-compensation-completion signal to the system controlling circuit.

S03 of, by the system controlling circuit, after the shutting-down compensation is completed, controlling the power-supply circuit to perform time-shared shutting-down to the output of the first power-supply voltage and the output of the second power-supply voltage comprises:

S03': by the system controlling circuit, acquiring the shutting-down-compensation-completion signal, and according to the shutting-down-compensation-completion signal, after the shutting-down compensation is completed, controlling the power-supply circuit to perform time-shared shutting-down to the output of the first power-supply voltage and the output of the second power-supply voltage.

Here, the system controlling circuit may, through the controlling signal transmitted via the controlling signal line, control the power-supply circuit to perform time-shared shutting-down to the output of the first power-supply voltage and the output of the second power-supply voltage.

A particular embodiment is provided below to illustrate the controlling method of the displaying device in the normal shutdown mode.

Figure 5:
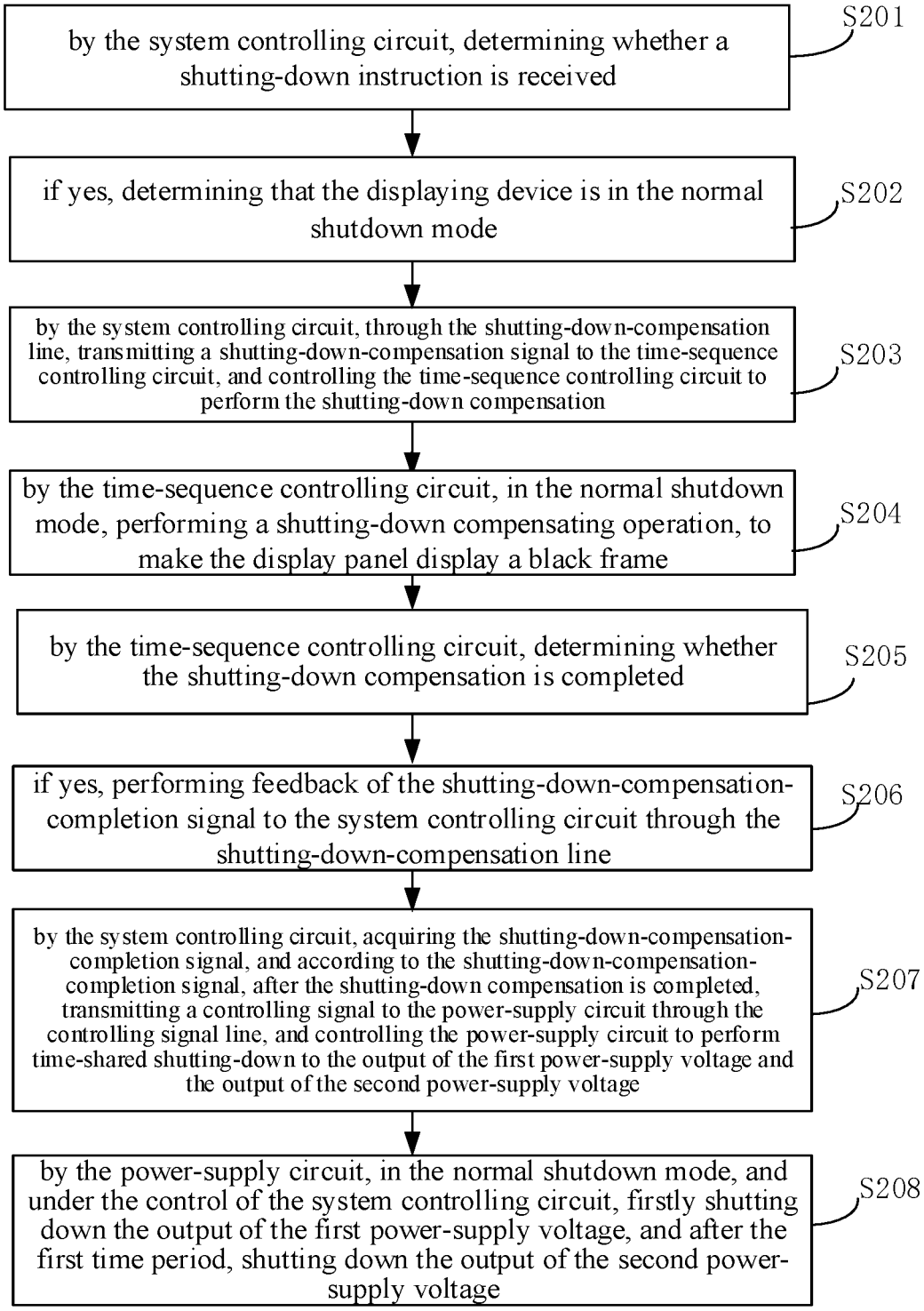
FIG. 5 schematically illustrates a flow chart of a controlling method when the displaying device is in the normal shutdown mode.

Referring to FIG. 5, the method comprises:

S201: by the system controlling circuit, determining whether a shutting-down instruction is received.

S202: if yes, determining that the displaying device is in the normal shutdown mode.

S203: by the system controlling circuit, through the shutting-down-compensation line, transmitting a shutting-down-compensation signal to the time-sequence controlling circuit, and controlling the time-sequence controlling circuit to perform the shutting-down compensation.

S204: by the time-sequence controlling circuit, in the normal shutdown mode, performing a shutting-down compensating operation, to make the display panel display a black frame.

S205: by the time-sequence controlling circuit, determining whether the shutting-down compensation is completed.

S206: if yes, performing feedback of the shutting-down-compensation-completion signal to the system controlling circuit through the shutting-down-compensation line.

S207: by the system controlling circuit, acquiring the shutting-down-compensation-completion signal, and according to the shutting-down-compensation-completion signal, after the shutting-down compensation is completed, transmitting a controlling signal to the power-supply circuit through the controlling signal line, and controlling the power-supply circuit to perform time-shared shutting-down to the output of the first power-supply voltage and the output of the second power-supply voltage.

S208: by the power-supply circuit, in the normal shutdown mode, and under the control of the system controlling circuit, firstly shutting down the output of the first power-supply voltage, and after the first time period, shutting down the output of the second power-supply voltage.

Figure 3:
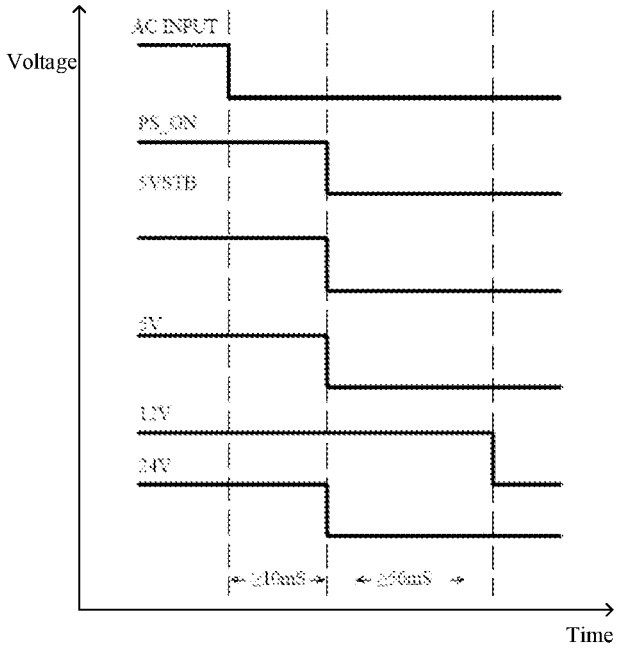
FIG. 3 schematically illustrates a diagram of a shutting-down time sequence of the displaying device.

Taking the first power-supply voltage comprising the voltage of 24 v and the second power-supply voltage comprising the voltage of 12 v as an examples, the shutdown controlling method of the displaying device sated above is described. Referring to FIG. 3, after pressing the shutting-down key, the AC INPUT signal (AC electrical signal) of the displaying device is shut down, and reversed from the high-level voltage to the low-level voltage. After greater than or equal to 10 ms, the controlling signal (PS_ON signal) transmitted from the system controlling circuit to the power-supply circuit, the standby power supply signal (5 vSTB signal) transmitted from the power-supply circuit to the system controlling circuit, the 5 v power-supply voltage signal transmitted from the power-supply circuit to the system controlling circuit, and the 24 v power-supply voltage signal transmitted from the power-supply circuit to the time-sequence controlling circuit reversed from the high-level voltage to the low-level voltage. After greater than or equal to 50 ms, the 12 v power-supply voltage signal transmitted from the power-supply circuit to the time-sequence controlling circuit is reversed from the high-level voltage to the low-level voltage. In the normal shutdown mode, the power-supply circuit first shuts down the output of 5 v and 24 v power-supply voltage, and then shuts down the output of 12 v power-supply voltage after the first time period.

Figure 4:
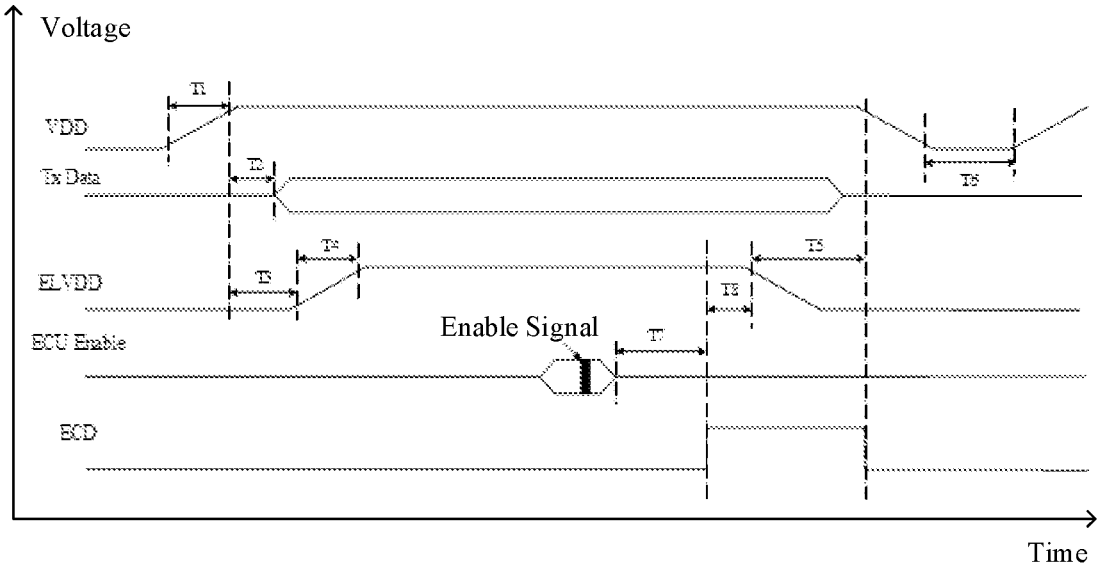
FIG. 4 schematically illustrates a diagram of a shutting-down time sequence when the displaying device is in the normal shutdown mode.

Referring to FIG. 4, VDD represents the second-power-supply-voltage signal outputted by the power-supply circuit, TxData represents the image-data signal transmitted by the system controlling circuit to the time-sequence controlling circuit, ELVDD represents the panel power-supply voltage signal outputted by the time-sequence controlling circuit to the display panel (the panel power-supply voltage signal is the same as the first-power-supply-voltage signal), ECU Enable represents the shutting-down-compensation signal outputted by the system controlling circuit to the time-sequence controlling circuit, and ECD represents the shutting-down-compensation signal transmitted by the time-sequence controlling circuit to the system controlling circuit.

In FIGS. 4, T1, T2, T3 and T4 stages are the normal power-on timing stage, and the compensation shutting-down stage occurs at T5, T7 and T8 stages. When the shutting-down instruction is received, the shutting-down-compensation signal ECU Enable issued by the system controlling circuit to the time-sequence controlling circuit generates the enabling signal. Then in the T7 stage, the time-sequence controlling circuit performs shutting-down compensating operation. After the compensation is completed, the shutting-down-compensation-completion signal ECD sent out by the time-sequence controlling circuit to the system controlling circuit reversed from the low-level voltage to the high-level voltage, and the system controlling circuit sends out the controlling signal to the power-supply circuit, to control the power-supply circuit to firstly shut down the output of the first power-supply voltage, and then shut down the output of the second-power-supply-voltage signal. In T8 and T5 stages, ELVDD is also powered off due to the shutting-down of the first power-supply voltage. After T5 stage ends, VDD starts and completes power-off, thus completing the shutting-down process in the normal shutdown mode. T6 is a preparation stage for the next stage. The values of T1-T8 in FIG. 4 are shown in Table 1 below.

TABLE 1

| | Values | | | | |
|---|---|---|---|---|---|
| Parameters | Minimum value | Types | Maximum value | Time units | Description |
| T1 | 1 | — | 35 | ms | |
| T2 | 1 | — | 500 | ms | |
| T3 | 5 | — | — | sec | |
| T4 | 5 | — | 50 | ms | |
| T5 | 50 | — | — | ms | |
| T6 | 1 | — | — | sec | |
| T7 | 1140 | — | 1170 | sec | Compensation stage |
| T8 | 0 | — | 7 | sec | |

In Table 1, ms represents milliseconds, and sec represents seconds. In Table 1, T5+T8 is about 50 ms; that is, after the compensation, the power-supply circuit, in 50 ms after shuts down the first-power-supply-voltage signal, shuts down the second-power-supply-voltage signal.

Optionally, the above method further comprises:

S10: by the time-sequence controlling circuit, determining whether the displaying device is in an abnormal shutdown mode, and if yes, stopping outputting the panel power-supply voltage to the display panel.

S11: by the power-supply circuit, determining whether the displaying device is in the abnormal shutdown mode, and if yes, according to a predetermined program, firstly shutting down the output of the first power-supply voltage, and after a second time period, shutting down the output of the second power-supply voltage.

In step S11, the power-supply circuit may shut down the first power-supply voltage and also the system power-supply voltage provided to the system controlling circuit simultaneously. If the first power-supply voltage comprises the voltage of 24 v, the system power-supply voltage comprises the voltage of 5 v, the second power-supply voltage comprises the voltage of 12 v, then in step S11, the power-supply circuit first shuts down 5 v and 12 v power-supply voltage, and in this case, the system controlling circuit is powered off; then turns off 12 v, the time-sequence controlling circuit is powered off. In step S10, the time-sequence controlling circuit stops outputting the panel power-supply voltage to the display panel, and the display panel is powered off. At this time, due to the 12 v power supply, the time-sequence controlling circuit is still not powered off. When the power-supply circuit shuts down the 12 v power-supply voltage, the time-sequence controlling circuit is powered off.

When the abnormal power-off occurs, the displaying device may execute the above step S10 and step S11 simultaneously. By executing the steps S10-S11, when the displaying device is in the abnormal shutdown mode (e.g., accidently power-off, etc.), the power-supply circuit, according to a predetermined program, firstly shuts down the output of the first power-supply voltage, and after a second time period, shuts down the output of the second power-supply voltage, so that the time-sequence controlling circuit can obtain the second power-supply voltage to prolong the operation when the first power-supply voltage is lost. Therefore, in case that the power supplying relies on merely the second power-supply voltage, the time-sequence controlling circuit may control to shut down the output of the panel power-supply voltage, so that the display panel is powered off quickly, so as to prevent the problem of residual images due to the residual charge in the sub-pixels of the display panel caused by untimely power-off of the display panel when the time-sequence controlling circuit is powered off earlier than the display panel.

Optionally, referring to FIG. 1, the displaying device further comprises an abnormal-power-off line 16 and a controlling signal line 14, the abnormal-power-off line 16 is electrically connected to the system controlling circuit 3 and the time-sequence controlling circuit 1, and the controlling signal line 14 is electrically connected to the system controlling circuit 3 and the power-supply circuit 2.

In the above step S10, the step of, by the time-sequence controlling circuit, determining whether the displaying device is in the abnormal shutdown mode comprises:

according to an abnormal-power-off signal transmitted via the abnormal-power-off line, determining whether the displaying device is in the abnormal shutdown mode.

Here, the method of, by the time-sequence controlling circuit, according to an abnormal-power-off signal transmitted via the abnormal-power-off line, determining whether the displaying device is in the abnormal shutdown mode is not limited. For example, in the normal working mode, the high-level voltage signal is transmitted to the abnormal-power-off line by the system controlling circuit. In the abnormal shutdown mode, the system controlling circuit is powered off and stops transmitting signals to the abnormal-power-off line, and then the voltage level of the abnormal-power-off signal transmitted via the abnormal-power-off line may be reversed. That is, it may be reversed from the high-level voltage signal into the low-level voltage signal. The time-sequence controlling circuit may determine whether the displaying device is in the abnormal shutdown mode through determining whether the voltage level of the abnormal-power-off signal is reversed. Particularly, if the voltage level of the abnormal-power-off signal is reversed, then it is determined that the displaying device is in the abnormal shutdown mode, and if the voltage level of the abnormal-power-off signal is not reversed, then it is determined that the displaying device is in the non-abnormal shutdown mode.

In the above step S11, the step of, by the power-supply circuit, determining whether the displaying device is in the abnormal shutdown mode comprises:

according to a controlling signal transmitted via the controlling signal line, determining whether the displaying device is in the abnormal shutdown mode.

Here, the method of, by the power-supply circuit, according to a controlling signal transmitted via the controlling signal line, determining whether the displaying device is in the abnormal shutdown mode is not limited. For example, in the normal working mode, the controlling signal with the high-level voltage may be transmitted to the controlling signal line through the system controlling circuit. In the normal shutdown mode, the controlling signal with the low-level voltage may be transmitted to the controlling signal line through the system controlling circuit. In the abnormal shutdown mode, the system controlling circuit is powered off and stops transmitting signals to the controlling signal line, then the controlling signal line may also output a certain level of controlling signals in a short period of time, and then no longer output signals. The power-supply circuit may determine whether the displaying device is in the abnormal shutdown mode by determining whether the controlling signal is continuously obtained. Particularly, if the power-supply circuit cannot continuously obtain the controlling signal, the displaying device is determined to be in the abnormal shutdown mode, and if the power-supply circuit can continuously obtain the controlling signal, the displaying device is determined to be in the non-abnormal shutdown mode.

Figure 6:
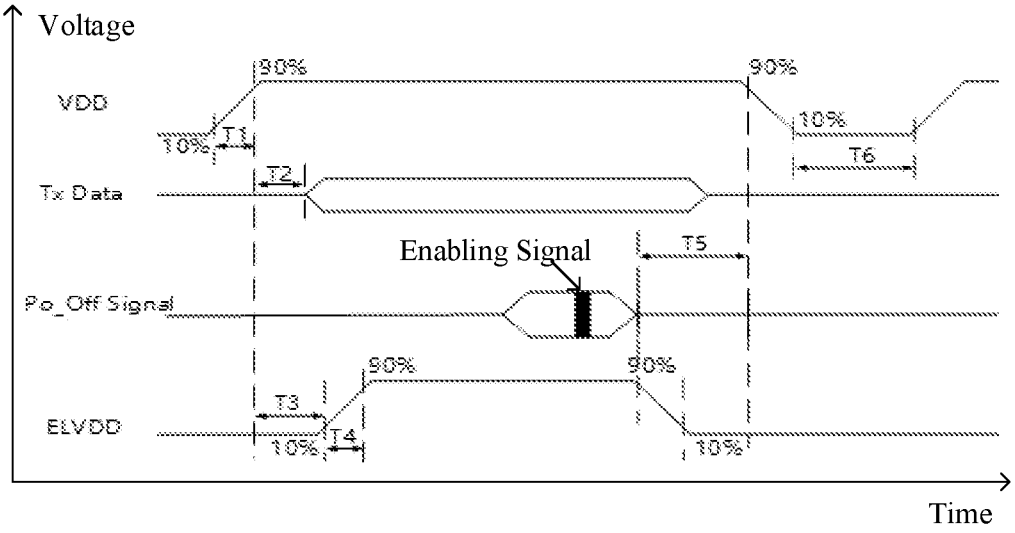
FIG. 6 schematically illustrates a diagram of a shutting-down time sequence when the displaying device is in the abnormal shutdown mode.

Referring to FIG. 6, which particularly illustrates the shutting-down controlling method of the displaying device under the abnormal shutdown mode. In FIG. 6, VDD represents the second-power-supply-voltage signal outputted by the power-supply circuit, TxData represents the image-data signal transmitted by the system controlling circuit to the time-sequence controlling circuit, ELVDD represents the panel power-supply voltage signal outputted by the time-sequence controlling circuit to the display panel (the panel power-supply voltage signal is the same as the first-power-supply-voltage signal), Po-Off Signal represents the abnormal-power-off signal transmitted by the system controlling circuit to the time-sequence controlling circuit. In FIGS. 6, T1, T2, T3 and T4 stages are the normal power-on timing stages, and the abnormal power-off trigger stages occur in T5 and T6 stages. When an abnormal power-off occurs, the first power-supply voltage and the panel power-supply voltage outputted by the power-supply circuit may be immediately powered off. The Po-Off Signal appears enabling signal (signal level reverse), the time-sequence controlling circuit determines to enter the abnormal shutdown mode, and then the panel power-supply voltage signal ELVDD is powered off. After T5, the second power-supply voltage VDD outputted by the power-supply circuit is powered off, thus the shutting-down is completed. In FIG. 6, the above electric stage T1, T4 are shown as an example of the power-on stage when the voltage rises from 10% to 90%, and the power-off stage when the voltage drops from 90% to 10%. The values of T1-T6 in FIG. 6 may be referenced in Table 2 below.

TABLE 2

| | Values | | | Time |
|---|---|---|---|---|
| Parameters | Minimum value | Types | Maximum value | units |
| T1 | 1 | — | 35 | ms |
| T2 | 1 | — | 500 | ms |
| T3 | 5 | — | — | sec |
| T4 | 5 | — | 50 | ms |
| T5 | 1500 | — | 2000 | ms |
| T6 | 1 | — | — | sec |

In Table 2, ms represents milliseconds, and sec represents seconds. In Table 2, the range of T5 is 1500-2000 ms, so after the first-power-supply-voltage signal 2000 ms (T5 stage is completed) is shut down by the power-supply circuit, then the second-power-supply-voltage signal is shut down, so as to complete the time-shared power-off.

The "one embodiment", "an embodiment" or "one or more embodiments" as used herein means that particular features, structures or characteristics described with reference to an embodiment are included in at least one embodiment of the present application. Moreover, it should be noted that here an example using the wording "in an embodiment" does not necessarily refer to the same one embodiment.

The description provided herein describes many concrete details. However, it can be understood that the embodiments of the present application may be implemented without those concrete details. In some of the embodiments, well-known processes, structures and techniques are not described in detail, so as not to affect the understanding of the description.

Finally, it should be noted that the above embodiments are merely intended to explain the technical solutions of the present application, and not to limit them. Although the present application is explained in detail with reference to the above embodiments, a person skilled in the art should understand that he can still modify the technical solutions set forth by the above embodiments, or make equivalent substitutions to part of the technical features of them. However, those modifications or substitutions do not make the essence of the corresponding technical solutions depart from the spirit and scope of the technical solutions of the embodiments of the present application.

The invention claimed is:

1. A displaying device, wherein the displaying device comprises: a time-sequence controlling circuit, a power-supply circuit, a system controlling circuit and a display panel;

the power-supply circuit is electrically connected to the time-sequence controlling circuit and the system controlling circuit, and is configured for: providing a first power-supply voltage and a second power-supply voltage to the time-sequence controlling circuit, wherein a magnitude of the first power-supply voltage and a magnitude of the second power-supply voltage are different; and in a normal shutdown mode, and under control of the system controlling circuit, firstly shutting down an output of the first power-supply voltage, and after a first time period, shutting down an output of the second power-supply voltage;

the time-sequence controlling circuit is electrically connected to the display panel, and is configured for: in the normal shutdown mode, and before the power-supply circuit performs time-shared shutting-down to the output of the first power-supply voltage and the output of the second power-supply voltage, performing a shutting-down compensating operation, to make the display panel display a black frame; and after the power-supply circuit shuts down the output of the first power-supply voltage, and before the power-supply circuit shuts down the output of the second power-supply voltage, stopping outputting a panel power-supply voltage to the display panel; and the system controlling circuit is electrically connected to the time-sequence controlling circuit, and is configured for: determining whether the displaying device is in the normal shutdown mode; if yes, controlling the time-sequence controlling circuit to perform a shutting-down compensation; and after the shutting-down compensation is completed, controlling the power-supply circuit to perform time-shared shutting-down to the output of the first power-supply voltage and the output of the second power-supply voltage.

2. The displaying device according to claim 1, wherein the displaying device further comprises a controlling signal line, and the controlling signal line is electrically connected to the system controlling circuit and the power-supply circuit; and the power-supply circuit is further configured for: in the normal shutdown mode, and under the control of the system controlling circuit by using a controlling signal transmitted via the controlling signal line, firstly shutting down the output of the first power-supply voltage, and after the first time period, shutting down the output of the second power-supply voltage.

3. The displaying device according to claim 1, wherein the time-sequence controlling circuit is further configured for: in the normal shutdown mode, and before the power-supply circuit performs time-shared shutting-down to the output of the first power-supply voltage and the output of the second power-supply voltage, outputting a black-frame image-data signal to the display panel, to make the display panel display the black frame.

4. The displaying device according to claim 1, wherein the time-sequence controlling circuit is further configured for: after performing the shutting-down compensating operation, determining whether the shutting-down compensation is completed; and if yes, performing feedback of a shutting-down-compensation-completion signal to the system controlling circuit; and the system controlling circuit is further configured for: acquiring the shutting-down-compensation-completion signal, and according to the shutting-down-compensation-completion signal, after the shutting-down compensation is completed, controlling the power-supply circuit to perform time-shared shutting-down to the output of the first power-supply voltage and the output of the second power-supply voltage.

5. The displaying device according to claim 4, wherein the displaying device further comprises: a shutting-down-compensation line; and the time-sequence controlling circuit is further configured for: performing feedback of the shutting-down-compensation-completion signal to the system controlling circuit through the shutting-down-compensation line.

6. The displaying device according to claim 1, wherein the system controlling circuit is further configured for: determining whether a shutting-down instruction is received; and if yes, determining that the displaying device is in the normal shutdown mode.

7. The displaying device according to claim 1, wherein the displaying device further comprises: a shutting-down-compensation line; and the system controlling circuit is further configured for: through the shutting-down-compensation line, transmitting a shutting-down-compensation signal to the time-sequence controlling circuit, and controlling the time-sequence controlling circuit to perform the shutting-down compensation.

8. The displaying device according to claim 1, wherein the displaying device further comprises a controlling signal line, and the controlling signal line is electrically connected to the system controlling circuit and the power-supply circuit; and the system controlling circuit is further configured for: after the shutting-down compensation is completed, transmitting a controlling signal to the power-supply circuit through the controlling signal line, and controlling the power-supply circuit to perform time-shared shutting-down to the output of the first power-supply voltage and the output of the second power-supply voltage.

9. The displaying device according to claim 1, wherein the time-sequence controlling circuit is further configured for: determining whether the displaying device is in an abnormal shutdown mode; and if yes, stopping outputting the panel power-supply voltage to the display panel; and the power-supply circuit is further configured for: determining whether the displaying device is in the abnormal shutdown mode; and if yes, according to a predetermined program, firstly shutting down the output of the first power-supply voltage, and after a second time period, shutting down the output of the second power-supply voltage.

10. The displaying device according to claim 9, wherein the displaying device further comprises an abnormal-power-off line and a controlling signal line, the abnormal-power-off line is electrically connected to the system controlling circuit and the time-sequence controlling circuit, and the controlling signal line is electrically connected to the system controlling circuit and the power-supply circuit;

the time-sequence controlling circuit is further configured for: according to an abnormal-power-off signal transmitted via the abnormal-power-off line, determining whether the displaying device is in the abnormal shutdown mode;

the power-supply circuit is further configured for: according to a controlling signal transmitted via the controlling signal line, determining whether the displaying device is in the abnormal shutdown mode; and the system controlling circuit is further configured for: in the abnormal shutdown mode, stopping transmitting signals to the abnormal-power-off line and the controlling signal line.

11. The displaying device according to claim 1, wherein the time-sequence controlling circuit comprises a time-sequence controlling board, the power-supply circuit comprises a power-supply board and the system controlling circuit comprises a main board.

12. The displaying device according to claim 1, wherein the system controlling circuit is further configured for: determining whether a starting-up instruction is received; and if yes, controlling the power-supply circuit to start up the output of the first power-supply voltage and the output of the second power-supply voltage; and the power-supply circuit is further configured for: under the control of the system controlling circuit, starting up the output of the first power-supply voltage and the output of the second power-supply voltage.

13. The displaying device according to claim 12, wherein the displaying device further comprises a controlling signal line, and the controlling signal line is electrically connected to the system controlling circuit and the power-supply circuit;

the system controlling circuit is further configured for: transmitting a controlling signal to the power-supply circuit through the controlling signal line, and controlling the power-supply circuit to start up the output of the first power-supply voltage and the output of the second power-supply voltage; and the power-supply circuit is further configured for: under the control of the controlling signal outputted by the system controlling circuit, starting up the output of the first power-supply voltage and the output of the second power-supply voltage.

14. The displaying device according to claim 1, wherein the displaying device further comprises: a first power-supply line and a second power-supply line, the first power-supply line is electrically connected to the power-supply circuit and the time-sequence controlling circuit, and the second power-supply line is electrically connected to the power-supply circuit and the time-sequence controlling circuit; and the power-supply circuit is further configured for: providing the first power-supply voltage to the time-sequence controlling circuit through the first power-supply line; and providing the second power-supply voltage to the time-sequence controlling circuit through the second power-supply line.

15. The displaying device according to claim 1, wherein the first power-supply voltage is greater than the second power-supply voltage.

16. A controlling method of the displaying device according to claim 1, wherein the displaying device comprises: a time-sequence controlling circuit, a power-supply circuit, a system controlling circuit and a display panel, and the controlling method comprises:

by the system controlling circuit, determining whether the displaying device is in a normal shutdown mode, and if yes, controlling the time-sequence controlling circuit to perform a shutting-down compensation;

by the time-sequence controlling circuit, in the normal shutdown mode, performing a shutting-down compensating operation, to make the display panel display a black frame;

by the system controlling circuit, after the shutting-down compensation is completed, controlling the power-supply circuit to perform time-shared shutting-down to the output of the first power-supply voltage and the output of the second power-supply voltage;

by the power-supply circuit, in the normal shutdown mode, and under control of the system controlling circuit, firstly shutting down an output of the first power-supply voltage, and after a first time period, shutting down an output of the second power-supply voltage; and by the time-sequence controlling circuit, after the power-supply circuit shuts down the output of the first power-supply voltage, and before the power-supply circuit shuts down the output of the second power-supply voltage, stopping outputting a panel power-supply voltage to the display panel.

17. The method according to claim 16, wherein the step of, by the system controlling circuit, determining whether the displaying device is in the normal shutdown mode comprises:

by the system controlling circuit, determining whether a shutting-down instruction is received; and if yes, determining that the displaying device is in the normal shutdown mode.

18. The method according to claim 16, wherein the step of, by the time-sequence controlling circuit, in the normal shutdown mode, performing the shutting-down compensating operation, to make the display panel display the black frame comprises:

by the time-sequence controlling circuit, in the normal shutdown mode, outputting a black-frame image-data signal to the display panel, to make the display panel display the black frame.

19. The method according to claim 16, wherein after the step of, by the time-sequence controlling circuit, in the normal shutdown mode, performing the shutting-down compensating operation, to make the display panel display the black frame, and before the step of, by the system controlling circuit, after the shutting-down compensation is completed, controlling the power-supply circuit to perform time-shared shutting-down to the output of the first power-supply voltage and the output of the second power-supply voltage, the method further comprises:

by the time-sequence controlling circuit, determining whether the shutting-down compensation is completed;

if yes, performing feedback of a shutting-down-compensation-completion signal to the system controlling circuit; and the step of, by the system controlling circuit, after the shutting-down compensation is completed, controlling the power-supply circuit to perform time-shared shutting-down to the output of the first power-supply voltage and the output of the second power-supply voltage comprises:

by the system controlling circuit, acquiring the shutting-down-compensation-completion signal, and according to the shutting-down-compensation-completion signal, after the shutting-down compensation is completed, controlling the power-supply circuit to perform time-shared shutting-down to the output of the first power-supply voltage and the output of the second power-supply voltage.

20. The method according to claim 16, wherein the method further comprises:

by the time-sequence controlling circuit, determining whether the displaying device is in an abnormal shutdown mode, and if yes, stopping outputting the panel power-supply voltage to the display panel; and by the power-supply circuit, determining whether the displaying device is in the abnormal shutdown mode, and if yes, according to a predetermined program, firstly shutting down the output of the first power-supply voltage, and after a second time period, shutting down the output of the second power-supply voltage.

* * * * *